US006421871B1

(12) United States Patent
Peach et al.

(10) Patent No.: US 6,421,871 B1
(45) Date of Patent: Jul. 23, 2002

(54) PIPE CLEARING APPARATUS

(76) Inventors: Danny L. Peach; Ray Peach, both of 522 S. La Fayette, Beaver Dam, KY (US) 42320

( * ) Notice: Subject to any disclaimer, the term of this patent is extended or adjusted under 35 U.S.C. 154(b) by 0 days.

(21) Appl. No.: 09/810,041

(22) Filed: Mar. 16, 2001

(51) Int. Cl.[7] ..... B08B 1/00

(52) U.S. Cl. ..... 15/104.33; 15/104.05; 15/104.16; 15/104.31

(58) Field of Search ..... 15/104.05, 104.31, 15/104.33, 104.16, 104.095

(56) References Cited

U.S. PATENT DOCUMENTS

| | | | | |
|---|---|---|---|---|
| 566,110 | A | * | 8/1896 | Wrigley |
| 1,780,436 | A | * | 11/1930 | Miller |
| 1,851,766 | A | | 3/1932 | Hotchkis, Jr. |
| 3,121,244 | A | | 2/1964 | Hunt |
| 4,174,548 | A | | 11/1979 | Dunn |
| 4,364,140 | A | | 12/1982 | Irwin |
| 4,617,693 | A | | 10/1986 | Meyer et al. |
| D303,855 | S | | 10/1989 | Moss |

FOREIGN PATENT DOCUMENTS

| | | | | |
|---|---|---|---|---|
| DE | 187052 | * | 10/1956 | ..... 15/104.33 |
| GB | 23604 | * | 10/1913 | ..... 15/104.33 |

* cited by examiner

*Primary Examiner*—Randall E. Chin

(57) ABSTRACT

A pipe cleaning apparatus which includes an elongated housing having first and second ends with a peripheral wall extending therebetween. Each of the ends includes an opening therein. An elongated drive member has first and second ends, with the first end being positioned in the housing. Attached to the second end of the drive member is a handle member. A leader member has first and second ends, with the second end being positioned in the housing and being releasably coupled to the first end of the drive member. Also included are a plurality of attachments releasably couplable to the first end of the leader member, and each attachment comprises a plate with a peripheral wall extending downwardly therefrom such that an opening is defined.

19 Claims, 7 Drawing Sheets

PIPE CLEARING APPARATUS

BACKGROUND OF THE INVENTION

1. Field of the Invention

The present invention relates to augers and more particularly pertains to a new pipe clearing apparatus for clearing pipes of a variety of clogs.

2. Description of the Prior Art

The use of augers is known in the prior art. More specifically, augers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,851,766; U.S. Pat. No. 3,121,244; U.S. Pat. No. 4,174,548; U.S. Pat. No. 4,364,140; U.S. Pat. No. 4,617,693; and U.S. Pat. No. Des. 303,855.

While these devices fulfill their respective, particular objectives and requirements, the aforementioned patents do not disclose a new pipe clearing apparatus. The inventive device includes a pipe clearing apparatus comprising an elongated housing. The elongated housing includes a first end and a second end with a peripheral wall extending therebetween. Each of the ends includes an opening therein. The pipe clearing apparatus also includes a drive member. The drive member is elongated and includes a first end and a second end. The first end of the drive member is positioned in the housing. Attached to the drive member is a handle member. The handle member is integrally coupled to the second end of the drive member. The pipe clearing apparatus further includes a leader member. The leader member includes a first end and a second end. The second end of the leader member is positioned generally in the housing and is releasably coupled to the first end of the drive member. There are a plurality of attachments. Each of the attachments comprises a plate that includes a peripheral wall extending downwardly therefrom such that an opening is defined. Each of the plates includes a top surface.

In these respects, the pipe clearing apparatus according to the present invention substantially departs from the conventional concepts and designs of the prior art, and in so doing provides an apparatus primarily developed for the purpose of clearing pipes of a variety of clogs.

SUMMARY OF THE INVENTION

In view of the foregoing disadvantages inherent in the known types of augers now present in the prior art, the present invention provides a new pipe clearing apparatus construction wherein the same can be utilized for clearing pipes of a variety of clogs.

The general purpose of the present invention, which will be described subsequently in greater detail, is to provide a new pipe clearing apparatus apparatus and method which has many of the advantages of the augers mentioned heretofore and many novel features that result in a new pipe clearing apparatus which is not anticipated, rendered obvious, suggested, or even implied by any of the prior art augers, either alone or in any combination thereof.

To attain this, the present invention generally comprises a pipe clearing apparatus comprising an elongated housing. The elongated housing includes a first end and a second end with a peripheral wall extending therebetween. Each of the ends includes a opening therein. The pipe clearing apparatus also includes a drive member. The drive member is elongated and includes a first end and a second end. The first end of the drive member is positioned in the housing. Attached to the drive member is a handle member. The handle member is integrally coupled to the second end of the drive member. The pipe clearing apparatus further includes a leader member. The leader member includes a first end and a second end. The second end of the leader member is positioned generally in the housing and is releasably coupled to the first end of the drive member. There are a plurality of attachments. Each of the attachments comprises a plate that includes a peripheral wall extending downwardly therefrom such that an opening is defined. The plate includes a top surface. Each of the attachments is eleasably couplable to the first end of the leader member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pipe clearing apparatus apparatus and method which has many of the advantages of the augers mentioned heretofore and many novel features that result in a new pipe clearing apparatus which is not anticipated, rendered obvious, suggested, or even implied by any of the prior art augers, either alone or in any combination thereof.

It is another object of the present invention to provide a new pipe clearing apparatus which may be easily and efficiently manufactured and marketed.

It is a further object of the present invention to provide a new pipe clearing apparatus which is of a durable and reliable construction.

An even further object of the present invention is to provide a new pipe clearing apparatus which is susceptible of a low cost of manufacture with regard to both materials and labor, and which accordingly is then susceptible of low prices of sale to the consuming public, thereby making such pipe clearing apparatus economically available to the buying public.

Still yet another object of the present invention is to provide a new pipe clearing apparatus which provides in the apparatuses and methods of the prior art some of the advantages thereof, while simultaneously overcoming some of the disadvantages normally associated therewith.

Still another object of the present invention is to provide a new pipe clearing apparatus for clearing pipes of a variety of clogs.

Yet another object of the present invention is to provide a new pipe clearing apparatus which includes a pipe clearing apparatus comprising an elongated housing. The elongated housing includes a first end and a second end with a peripheral wall extending therebetween. Each of the ends includes a opening therein. The pipe clearing apparatus also includes a drive member. The drive member is elongated and includes a first end and a second end. The first end of the drive member is positioned in the housing. Attached to the drive member is a handle member. The handle member is integrally coupled to the second end of the drive member. The pipe clearing apparatus further includes a leader member. The leader member includes a first end and a second end. The second end of the leader member is positioned generally in the housing and is releasably coupled to the first end of the drive member. There are a plurality of attachments. Each of the attachments comprises a plate that includes a peripheral wall extending downwardly therefrom such that an opening is defined. Each of the plates includes a top surface. Each of the attachments is releasably couplable to the first end of the leader member.

Still yet another object of the present invention is to provide new pipe clearing apparatus that can be used by professionals and homeowners to clear their clogged pipes.

Even still another object of the present invention is to provide a new pipe clearing apparatus that provides a wide variety of attachments that will allows users to be able to handle a wide variety of clogs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
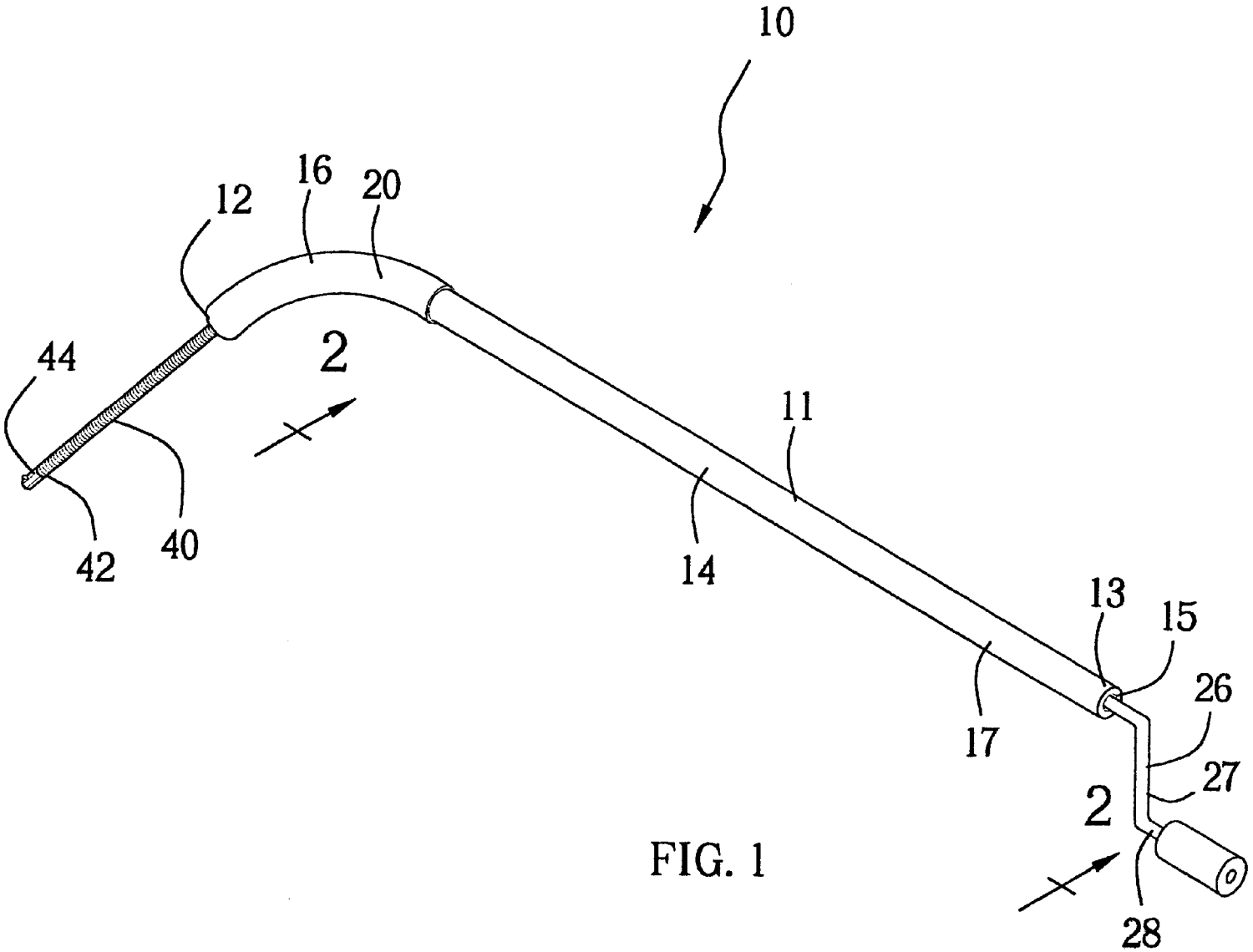
FIG. 1 is a schematic perspective view of a new pipe clearing apparatus according to the present invention.
Figure 2:
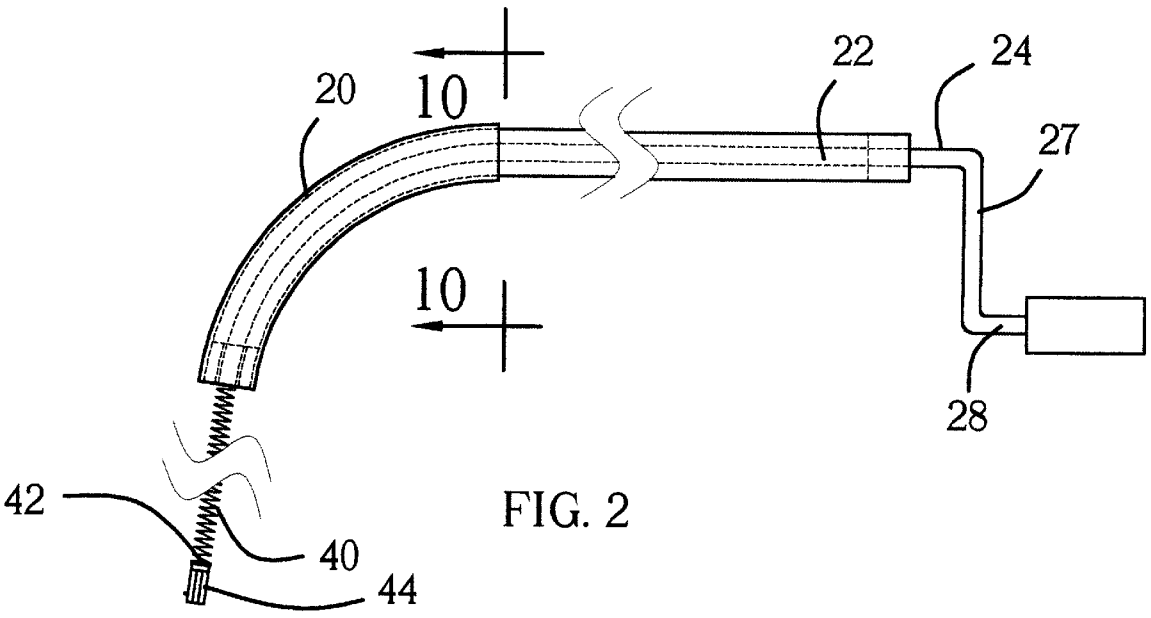
FIG. 2 is a schematic cross-sectional view of the present invention taken along line 2—2 of FIG. 1 and showing the leader member and the drive member in the housing.
Figure 3:
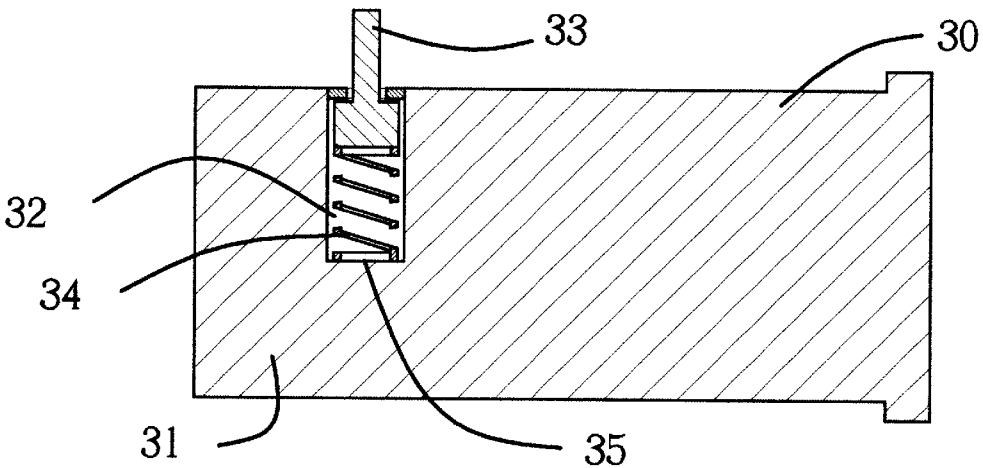
FIG. 3 is a schematic cross-sectional view of the present invention showing a one of the coupling members.
Figure 4:
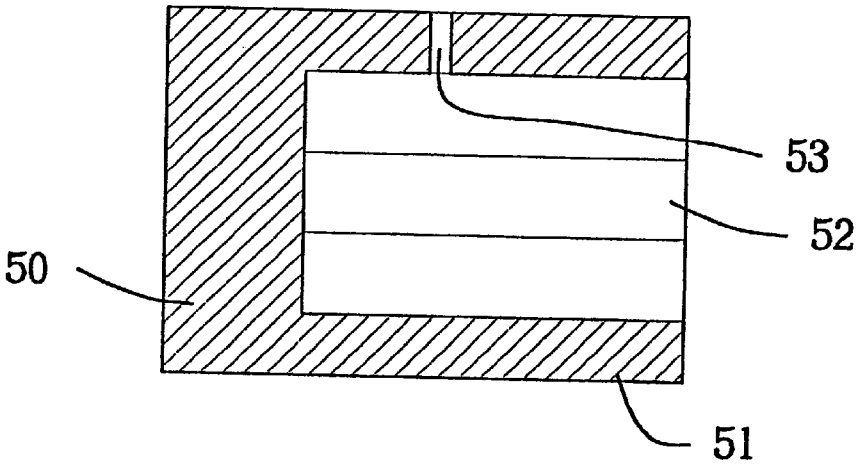
FIG. 4 is a schematic cross-sectional view of the present invention taken along line 4—4 of FIG. 7 and showing a female coupling member.
Figure 5:
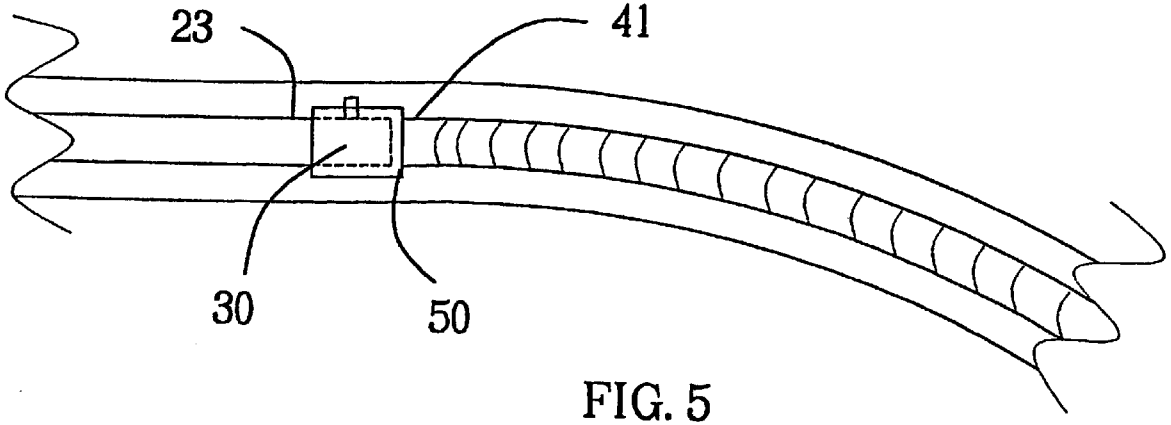
FIG. 5 is a schematic cross-sectional view of the present invention showing the coupling of the first coupling member to the female coupling member.
Figure 7:
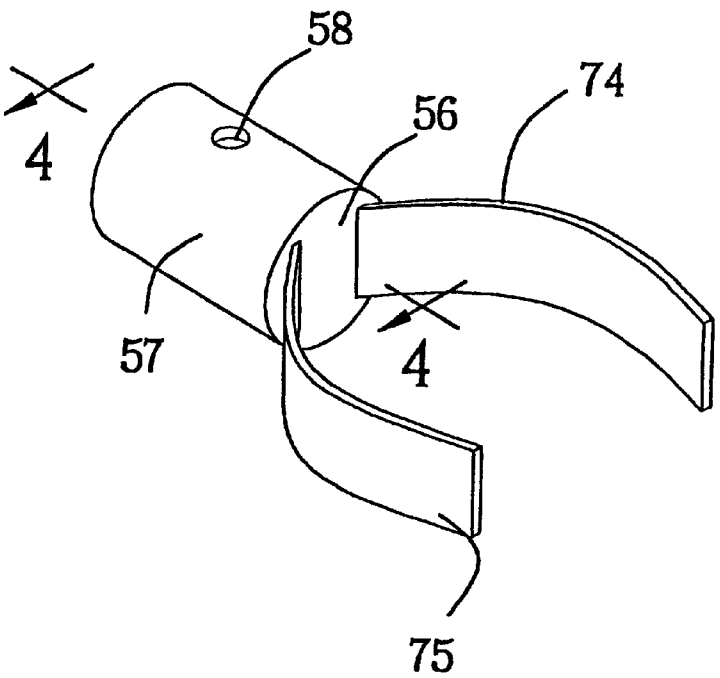
FIG. 7 is a schematic perspective view of the present invention showing a caliper member.
Figure 6:
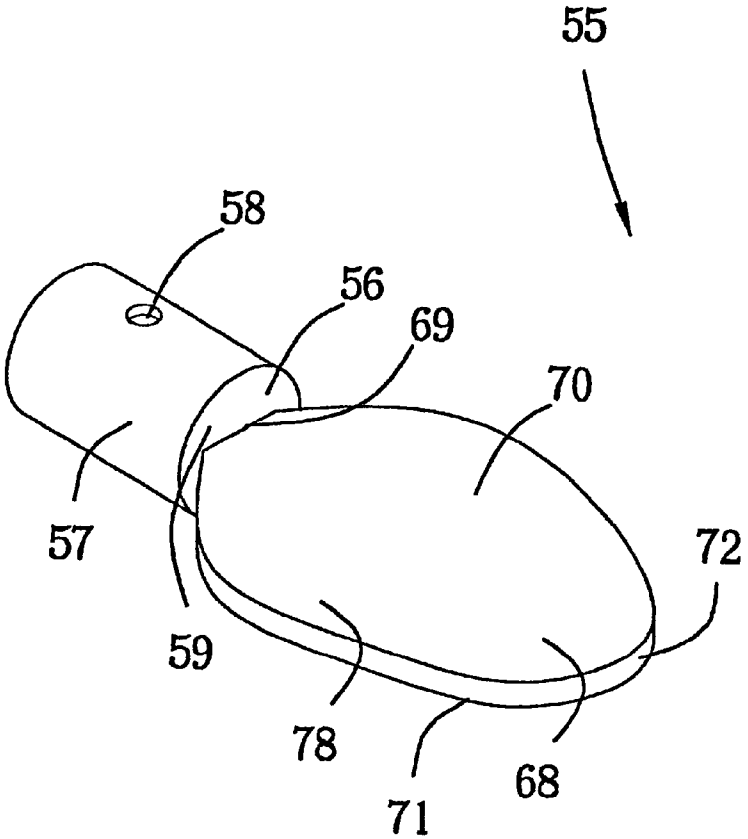
FIG. 6 is a schematic perspective view of the present invention showing a spear member.
Figure 10:
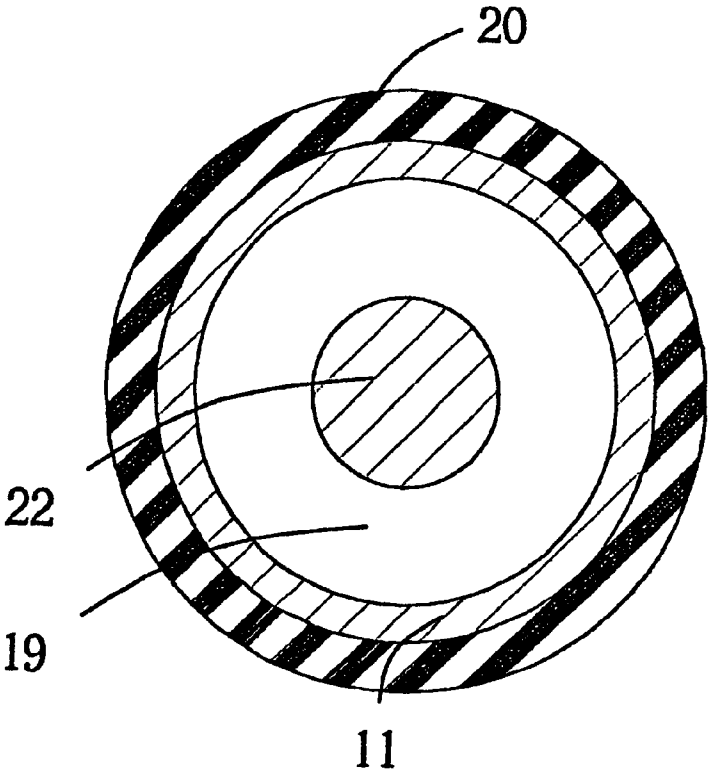
FIG. 10 is a schematic cross-sectional view of the present invention taken along line 10—10 of FIG. 2 and showing the tubing, grommet, and driving member.
Figure 8:
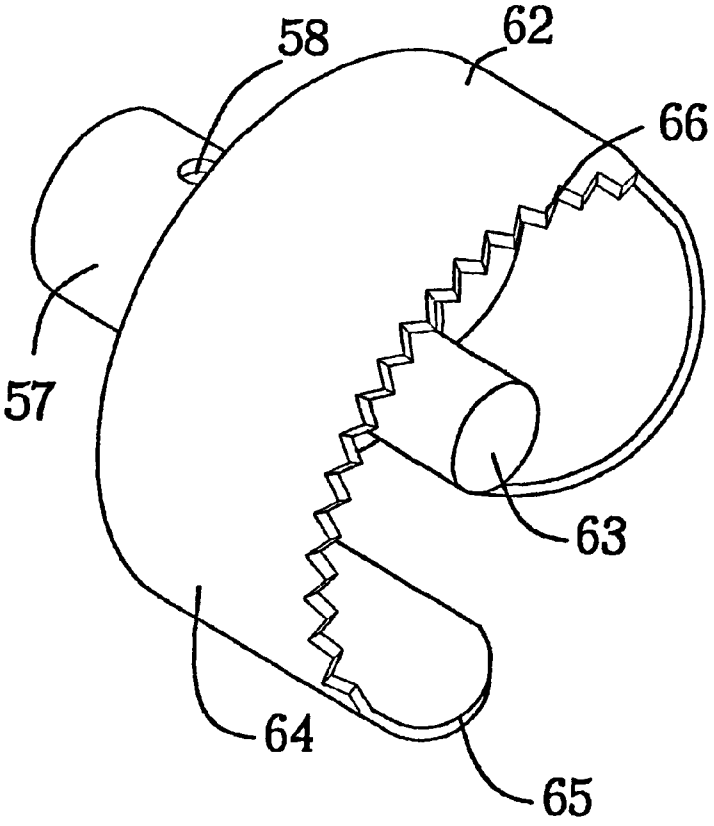
FIG. 8 is a schematic perspective view of the present invention showing a root cutter member.
Figure 9:
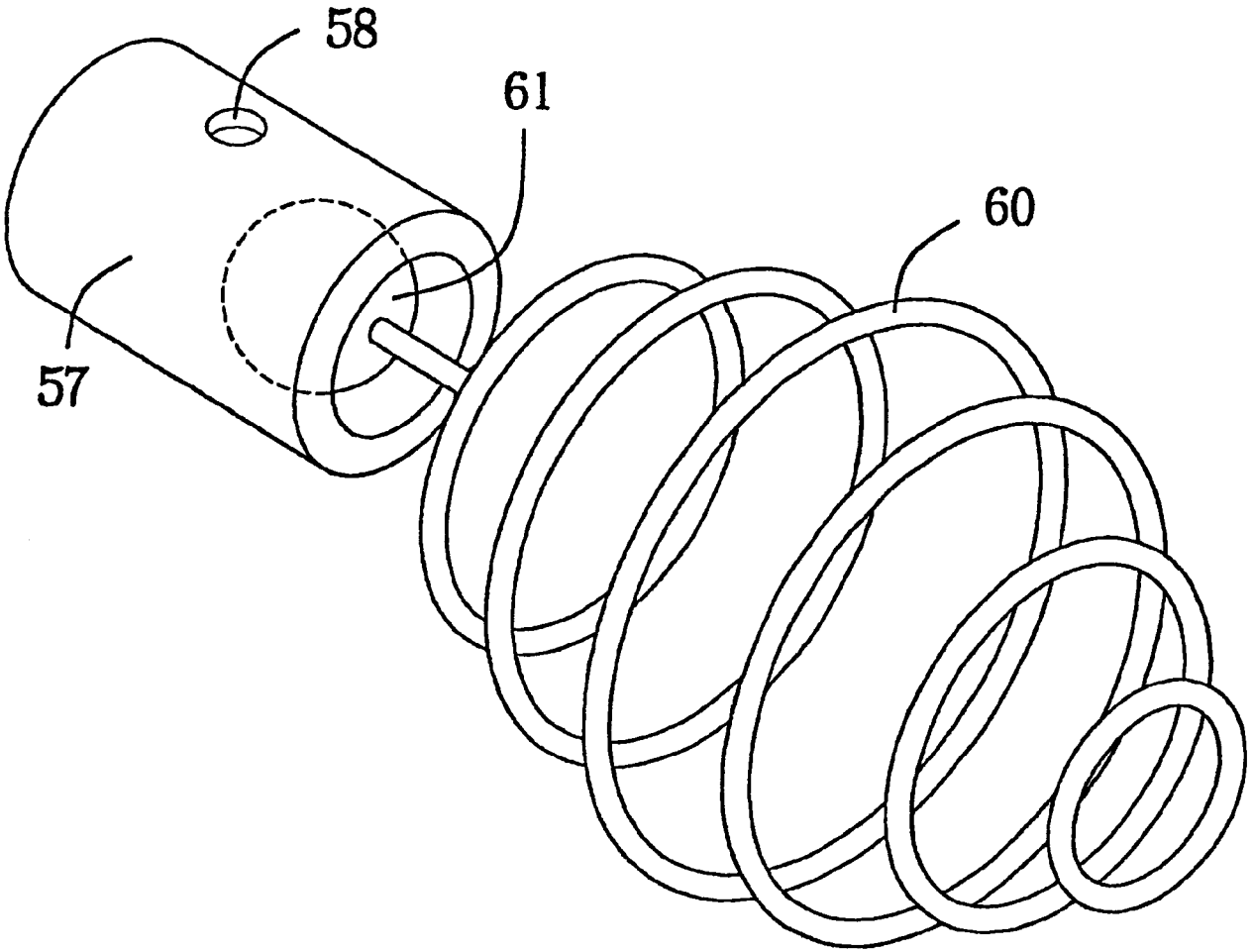
FIG. 9 is a schematic perspective view of the present invention showing a spiraled wire member.
Figure 11:
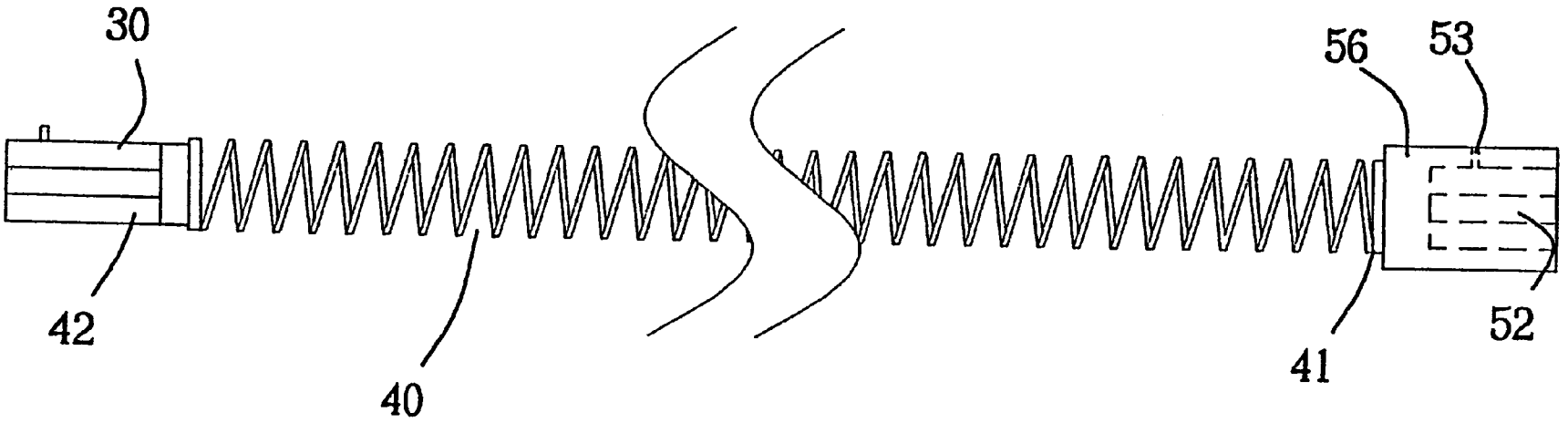
FIG. 11 is a schematic perspective view of the present invention showing the leader member with the second coupling member and the female coupling member.

With reference now to the drawings, and in particular to FIGS. 1 through 11 thereof, a new pipe clearing apparatus embodying the principles and concepts of the present invention and generally designated by the reference numeral 10 will be described.

As best illustrated in FIGS. 1 through 11, the pipe clearing apparatus 10 of the invention generally comprises an elongated housing 11. The elongated housing 11 has a first end 12 and a second end 13 with a peripheral wall 14 extending therebetween. Each of the ends 12 and 13 includes an opening 15 extending therein. The elongated housing 11 includes a first portion 16 and a second portion 17. The first portion 16 has a generally arcuate shape extending approximately half the length of the housing 11. The housing 11 has a generally tubular shape. Positioned in the openings 15 of the housing 1 is grommet 19 comprising a substantially rigid material such as, for example, a plastic.

There is a sleeve member 20 removably attached to the first portion 16 of the housing 11. The sleeve member 20 may comprise a resiliently flexible material such as, for example, rubber or foam. The sleeve member 20 protects the housing 11 from damage when the invention is being inserted into pipes. The sleeve member 20 also protects any bathroom fixtures that come into contact with the housing 11 while their pipes are being cleared.

There is a drive member 22 positioned in the housing 11. The drive member 22 is elongated having a first end 23 and a second end 24. The first end 23 of the drive member 22 is extendably positioned in the housing 11. The second end 24 of the drive member 22 extends outwardly through the opening 15 of the second end 13 of the housing 11.

Attached to the drive member 22 is a handle member 26. The handle member 26 has a leg 27 and a foot 28. The leg 27 is integrally coupled to and orientated generally perpendicular to the second end 24 of the drive member 22. The foot 28 is integrally coupled to the leg 27 and orientated generally parallel to the second end 24 of the drive member 22. The handle member 26 provides a means of rotating the drive member 22 within the housing 11. There may also be a formed handle grip securably coupled to the foot 28 for rotating the drive member 22, however, a formed handle grip is not required.

There is also a plurality of leader members 40 having a first end 41 and a second end 42. The first end 41 of the leader member 40 is positioned generally in the first portion 16 of the housing 11. The leader members 40 are generally flexible allowing them to maneuver through bends and turns in a length of pipe. The leader member 40 comprises generally a coiled shaft.

The invention includes a pair of coupling members. A first coupling member 30 is integrally coupled to and extending outwardly away from the first end 23 of the elongated drive member 22. A second coupling member 44 is securably coupled to the second end 42 of the leader members 40. Each of the coupling members comprises an outer peripheral wall 31 having a bore 32 extending therein. The bore 32 is generally orientated perpendicular to a longitudinal axis of the drive member 22. A detent member 33 is movably positionable in the bore 32. A biasing member 34 for biasing the detent member 33 outwardly from the bore 32 is positioned between the detent member 33 and a bottom wall 35 of the bore 32.

The leader members 40 also include a female coupling member 50. The female coupling member 50 comprising an outer peripheral wall 51 defining an aperture 52 therein. The first coupling member 30,having a size and shape for selectively positioning in the aperture 52 of the female coupling member 50. The outer peripheral wall 51 of the female coupling member 50 includes a hole 53 therein. The detent member 33 of the first coupling member 30 includes a size and shape for removably positioning in the hole 53 of the female coupling member 50.

Multiple leader members 40 may be coupled together by coupling a second coupling member 44 of a leader member 40 to a female coupling member of another leader member 40. The extended leader member 40 allows the present invention to clean longer lengths of pipes.

To facilitate clearing pipes there are a plurality of attachments 55. Each of the attachments 55 comprises a plate 56. The plate 56 includes a peripheral wall 57 extending downwardly therefrom such that an opening is defined. The coupling member 30 has a size and shape adapted for selectively positioning in the opening of one of the attachments. The peripheral walls of the attachments have an opening therein. The detent member 33 of the second coupling member 44 includes a size and shape for removably positioning in the opening 58 of the attachments 55. There is also a top surface 59 of each of the plates 56. The top surface 59 comprises a plurality of different members attached thereto.

A spiraled wire member 60 attached to a ball member 61 is pivotally coupled to and extending upwardly away from the top 59 surface of the plate 56. The spiraled wire member 60 comprises substantially rigid material such as, for example, steel or aluminum. The spiraled wire member has a generally coiled shape.

There is also a root cutter member 62. The root cutter member 62 includes a rod 63 integrally coupled to the top surface 59 of the plate 56 and extending upwardly away therefrom. The rod 63 includes a panel 64 integrally coupled thereto and coiled around the rod 63. A peripheral edge 65 of the panel 64 includes a plurality of teeth 66 therein. The panel 64 is made of a substantially rigid material. The panel 64 may be made of steel or iron or any other material that is substantially rigid.

The attachments 55 also include a spear member 68. The spear member 68 includes a base surface 69, a planar top surface 70, a planar bottom surface 71, and a peripheral edge 72. The base surface 69 is integrally coupled to the top surface 59 of the plate 56 and extending upwardly therefrom. The spear member 68 lies in a plane orientated generally coplanar to a longitudinal axis of the leader member 40. The spear member 68 is made of a substantially rigid material. The spear member 68 may be made of any substantially rigid material such as steel or iron.

The plurality of attachments 55 further include a caliper member 74. The caliper member 74 includes a pair of legs 75 integrally coupled to the top surface 59 of the plate 56 and extending upwardly therefrom. Each of the legs 75 includes a generally arcuate shape. The arcuate shape allows the legs to press against the walls of the pipe and clean them of any clogs. The caliper member 74 is made of any substantially rigid material such as steel or iron.

In use, the drive member 22 is removed from the elongated housing 11. The female coupling member 50 attached to the leader member 40 is attached to the first coupling member 30 on the drive member 22. The leader member 40 is then placed through the openings 15 in the housing and passed through the grommets to exit the housing 11 on the other side. Any of the attachments 55 are attached to the second coupling member 44 of the leader member 40. The leader member 40 and the attachment 55 are placed in the pipe to be cleared. The user then rotates the handle member 26 that results in the leader member 40 being rotated, thereby rotating the attachment 55 clearing the pipe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pipe clearing apparatus comprising:

an elongated housing, said elongated housing having a first end and a second end with a peripheral wall extending therebetween, each of said ends having an opening therein;

a drive member, said drive member being elongated and having a first end and a second end, said first end being positioned in said housing;

a handle member, said handle member being integrally coupled to said second end of said drive member;

a leader member, said leader member having a first end and a second end, said second end of said leader member being positioned generally in said housing and coupled to said first end of said drive member;

a plurality of attachments, each of said attachments comprising a plate having a peripheral wall extending downwardly therefrom such that an opening is defined, said plate having a top surface, each of said attachments being releasably couplable to said first end of said leader member;

wherein said housing comprises:

a first portion and a second portion, said first portion having a generally arcuate shape;

said first end of said drive member being positioned generally in said housing and positioned generally adjacent to said arcuate shape in said elongated housing;

a first coupling member being coupled to said first end of said drive member;

a second coupling member being coupled to said second end of said leader member;

a female coupling member comprising an outer peripheral wall defining an aperture therein, said female coupling member having a size and shape for being selectively positioned in said aperture of said female coupling member; and wherein each of said plurality of attachments is releasably coupled to said second coupling member;

wherein said plurality of attachments includes a root cutter member, said root cutter member having a rod integrally coupled to said top surface of said plate and extending upwardly away therefrom, said rod having a panel integrally coupled thereto and coiled around said rod, a peripheral edge of said panel having a plurality of teeth therein, said panel being substantially rigid.

2. The pipe clearing apparatus of claim 1, wherein:

each of said first and second coupling members comprises an outer peripheral wall having a bore extending therein, said bore being generally orientated perpendicular to a longitudinal axis of said drive member, a detent member being movably positionable in said bore, and a biasing member, said biasing member for biasing said detent member outwardly from said bore, said biasing member being positioned between said detent member and a bottom wall of said bore; and said female coupling member has a hole in said outer peripheral wall thereof, said detent of said second coupling member having a size and shape for being removably positioned in said hole of said female coupling member.

3. The pipe clearing apparatus of claim 1, further comprising:

a sleeve member, said sleeve member being removably attached to said housing, said sleeve being positioned generally adjacent said first end of said housing, said sleeve member being made of a resiliently flexible material.

4. The pipe clearing apparatus of claim 1, further comprising:

a sleeve member, said sleeve member being removably attached to first portion of said housing, said sleeve member being made of a resiliently flexible material.

5. The pipe clearing apparatus of claim 1, wherein said handle member further comprises:

said handle member having a leg and a foot, said leg being integrally coupled to and orientated generally perpendicular to said second end of said drive member, said foot being integrally coupled to said leg and orientated generally parallel to said second end of said drive member.

6. The pipe clearing apparatus of claim 1, wherein said leader member further comprises:

a plurality of leader members being releasably couplable together such that an extended leader member is defined, each of said leader members comprising a coiled shaft.

7. The pipe clearing apparatus of claim 1, wherein said plurality of attachments further comprises:

a spiraled wire member, said spiraled wire member being integrally coupled thereto and extending upwardly away from said top surface of said plate, said spiraled wire member being substantially rigid.

8. A pipe clearing apparatus comprising:

an elongated housing having a first end and a second end with a peripheral wall extending therebetween, each of said ends having an opening therein;

a drive member being elongated and having a first end and a second end, said first end being positioned in said housing;

a handle member being integrally coupled to said second end of said drive member;

a leader member having a first end and a second end, said second end of said leader member being positioned generally in said housing and coupled to said first end of said drive member;

a plurality of attachments, each of said attachments comprising a plate having a peripheral wall extending downwardly therefrom such that an opening is defined, said plate having a top surface, each of said attachments being releasably couplable to said first end of said leader member;

wherein said housing further comprises:

a first portion and a second portion, said first portion having a generally arcuate shape;

said first end of said drive member being positioned generally in said housing and positioned generally adjacent to said arcuate shape in said elongated housing;

a first coupling member being coupled to said first end of said drive member;

a second coupling member being coupled to said second end of said leader member;

a female coupling member comprising an outer peripheral wall defining an aperture therein, said female coupling member having a size and shape for being selectively positioned in said aperture of said female coupling member; and wherein each of said plurality of attachments is releasably coupled to said second coupling member;

wherein said plurality of attachments further comprises a spear member having a base surface, a planar top surface, a planar bottom surface, and a peripheral edge, said base surface being integrally coupled to said top surface of said plate and extending upwardly therefrom, said spear member lying in a plane orientated generally coplanar to a longitudinal axis of said leader member, said spear member being substantially rigid.

9. The pipe clearing apparatus of claim 8, wherein each of said first and second coupling members comprises an outer peripheral wall having a bore extending therein, said bore being generally orientated perpendicular to a longitudinal axis of said drive member, a detent member being movably positionable in said bore, and a biasing member, said biasing member for biasing said detent member outwardly from said bore, said biasing member being positioned between said detent member and a bottom wall of said bore; and said female coupling member has a hole in said outer peripheral wall thereof, said detent of said second coupling member having a size and shape for being removably positioned in said hole of said female coupling member.

10. The pipe clearing apparatus of claim 8, further comprising a sleeve member, said sleeve member being removably attached to first portion of said housing, said sleeve member being made of a resiliently flexible material.

11. The pipe clearing apparatus of claim 8, wherein said handle member further comprises a leg and a foot, said leg being integrally coupled to and orientated generally perpendicular to said second end of said drive member, said foot being integrally coupled to said leg and orientated generally parallel to said second end of said drive member.

12. The pipe clearing apparatus of claim 8, wherein said leader member further comprises a plurality of leader members being releasably couplable together such that an extended leader member is defined, each of said leader members comprising a coiled shaft.

13. The pipe clearing apparatus of claim 8, wherein said plurality of attachments further comprises a spiraled wire member, said spiraled wire member being integrally coupled thereto and extending upwardly away from said top surface of said plate, said spiraled wire member being substantially rigid.

14. A pipe clearing apparatus comprising:

an elongated housing having a first end and a second end with a peripheral wall extending therebetween, each of said ends having an opening therein;

a drive member being elongated and having a first end and a second end, said first end being positioned in said housing;

a handle member being integrally coupled to said second end of said drive member;

a leader member having a first end and a second end, said second end of said leader member being positioned generally in said housing and coupled to said first end of said drive member;

a plurality of attachments, each of said attachments comprising a plate having a peripheral wall extending downwardly therefrom such that an opening is defined, said plate having a top surface, each of said attachments being releasably couplable to said first end of said leader member;

wherein said housing further comprises:

a first portion and a second portion, said first portion having a generally arcuate shape;

said first end of said drive member being positioned generally in said housing and positioned generally adjacent to said arcuate shape in said elongated housing;

a first coupling member being coupled to said first end of said drive member;

a second coupling member being coupled to said second end of said leader member;

a female coupling member comprising an outer peripheral wall defining an aperture therein, said female coupling member having a size and shape for being selectively positioned in said aperture of said female coupling member; and wherein each of said plurality of attachments is releasably coupled to said second coupling member;

wherein said plurality of attachments further comprises a caliper member, said caliper member having a pair of legs integrally coupled to said top surface of said plate and extending upwardly therefrom, each of said legs having a generally arcuate shape, said caliper member being substantially rigid.

15. The pipe clearing apparatus of claim 14, wherein each of said first and second coupling members comprises an outer peripheral wall having a bore extending therein, said bore being generally orientated perpendicular to a longitudinal axis of said drive member, a detent member being movably positionable in said bore, and a biasing member, said biasing member for biasing said detent member outwardly from said bore, said biasing member being positioned between said detent member and a bottom wall of said bore; and said female coupling member has a hole in said outer peripheral wall thereof, said detent of said second coupling member having a size and shape for being removably positioned in said hole of said female coupling member.

16. The pipe clearing apparatus of claim 14, further comprising a sleeve member, said sleeve member being removably attached to first portion of said housing, said sleeve member being made of a resiliently flexible material.

17. The pipe clearing apparatus of claim 14, wherein said handle member further comprises a leg and a foot, said leg being integrally coupled to and orientated generally perpendicular to said second end of said drive member, said foot being integrally coupled to said leg and orientated generally parallel to said second end of said drive member.

18. The pipe clearing apparatus of claim 14, wherein said leader member further comprises a plurality of leader members being releasably couplable together such that an extended leader member is defined, each of said leader members comprising a coiled shaft.

19. The pipe clearing apparatus of claim 14, wherein said plurality of attachments further comprises a spiraled wire member, said spiraled wire member being integrally coupled thereto and extending upwardly away from said top surface of said plate, said spiraled wire member being substantially rigid.

* * * * *